US011685027B2

(12) United States Patent
Chen

(10) Patent No.: US 11,685,027 B2
(45) Date of Patent: Jun. 27, 2023

(54) NON-MAGNEIIC LOCKING SLEEVE

(71) Applicant: Ming-Chang Chen, Kaohsiung (TW)

(72) Inventor: Ming-Chang Chen, Kaohsiung (TW)

( * ) Notice: Subject to any disclaimer, the term of this patent is extended or adjusted under 35 U.S.C. 154(b) by 2 days.

(21) Appl. No.: 17/308,215

(22) Filed: May 5, 2021

(65) Prior Publication Data

US 2022/0168873 A1 Jun. 2, 2022

(30) Foreign Application Priority Data

Nov. 30, 2020 (TW) ..... 109215788

(51) Int. Cl.
*B25B 23/10* (2006.01)
*B25B 13/06* (2006.01)

(52) U.S. Cl.
CPC ..... *B25B 23/10* (2013.01); *B25B 13/065* (2013.01)

(58) Field of Classification Search
CPC ..... B25B 23/10; B25B 23/08; B25B 13/065; B25B 23/0035; B25B 23/108; B25B 23/101; B25B 13/107; B25B 13/06
USPC ..... 81/436, 119–125.1, 451, 452
See application file for complete search history.

(56) References Cited

U.S. PATENT DOCUMENTS 2,522,217 A * 9/1950 Fischer ..... B25B 23/0035 81/460
2,806,706 A * 9/1957 Fitch ..... B25B 23/0035 279/23.1
3,347,293 A * 10/1967 Clark ..... B25B 23/0035 403/DIG. 7
3,356,117 A * 12/1967 Wagner ..... B25B 15/00 81/177.5
4,991,468 A * 2/1991 Lee ..... B25B 13/463 81/185
5,195,624 A * 3/1993 Eriksson ..... B23B 31/086 192/143
5,485,769 A * 1/1996 Olson ..... B25B 23/0035 81/177.85
5,539,968 A * 7/1996 Meyer, Jr. ..... B25B 27/06 29/280
6,112,624 A * 9/2000 Chen ..... B25B 13/462 81/59.1
6,691,593 B2 * 2/2004 Hu ..... B25B 23/0035 403/DIG. 7
7,437,975 B1 * 10/2008 De Anfrasio ..... B25B 13/06 81/125

(Continued)

*Primary Examiner* — Don M Anderson
*Assistant Examiner* — Jason Khalil Hawkins
(74) *Attorney, Agent, or Firm* — Rosenberg, Klein & Lee

(57) ABSTRACT

A non-magnetic locking sleeve includes an engagement unit disposed in a body which includes a locking socket and a positioning groove. The locking socket is enclosed by a plurality of peripheral walls connected one after another for holding a fastener. The positioning groove is annularly recessed into the peripheral walls for receiving the engagement unit. Preferably, an intersection of two adjacent peripheral walls forms a recessed portion whereby the fastener is held by the peripheral walls more tightly while inserting into the locking socket. A periphery of the engagement unit can be formed with a rough surface or at least one engaging surface to increase a contact area between the engagement unit and the fastener. Accordingly, the fastener is firmly positioned by the locking sleeve to increase the stability of a following fastening operation executed by the fastener.

4 Claims, 4 Drawing Sheets

(56) References Cited

U.S. PATENT DOCUMENTS

| | | | | |
|---|---|---|---|---|
| 7,712,747 | B2 * | 5/2010 | Hu | B25B 23/0035 279/46.2 |
| 9,981,365 | B2 * | 5/2018 | Lin | B23B 31/107 |
| 2006/0234799 | A1 * | 10/2006 | Chiou | F16D 3/16 464/158 |
| 2014/0037394 | A1 * | 2/2014 | Patil | B23G 1/04 408/239 R |
| 2014/0083259 | A1 * | 3/2014 | Anderson | B25B 13/463 81/63.1 |

* cited by examiner

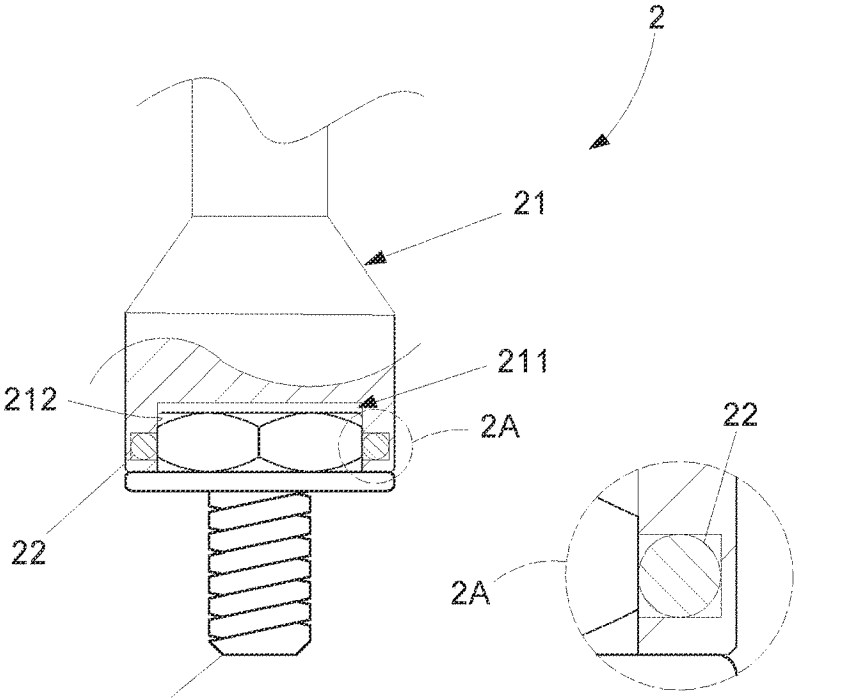
FIG. 2A
(PRIOR ART)
FIG. 2
(PRIOR ART)
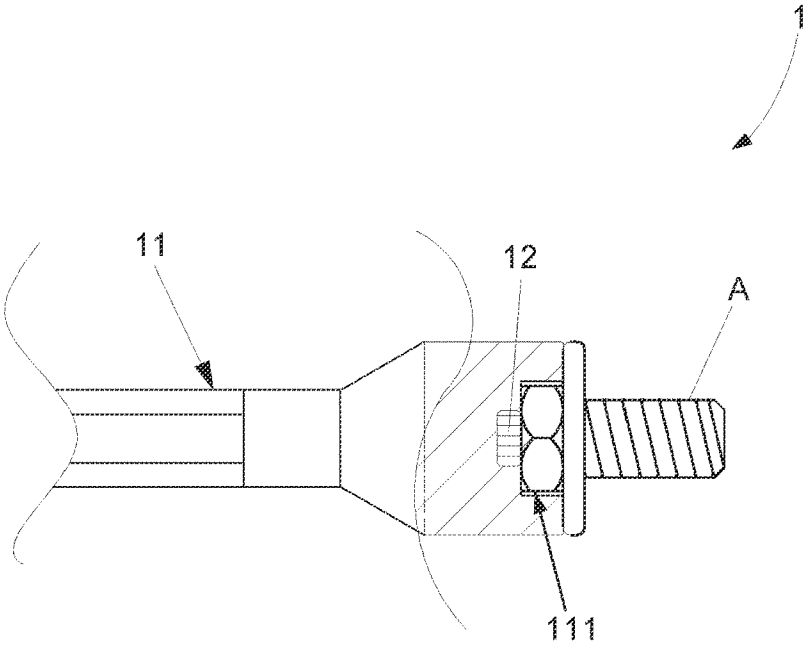
FIG. 1
(PRIOR ART)

NON-MAGNEIIC LOCKING SLEEVE

BACKGROUND OF THE INVENTION

1. Field of the Invention

This invention relates to a locking sleeve and relates particularly to a non-magnetic locking sleeve.

2. Description of the Related Art

With the development of industrial technology, fasteners such as bolts, nuts and screws are commonly used in the assembly of various products, and locking sleeves are widely used in the assembly and disassembly of the fastener with a hexagonal head. However, different hexagonal heads have different dimensional tolerances. In order that the locking sleeve can be adapted to the hexagonal heads with different dimensional tolerances, a locking socket formed inside the locking sleeve for accommodating the fastener has a large tolerance, and that causes the locking socket of the locking sleeve to be unable to hold the hexagonal heads of different fasteners tightly. Thus, larger force is required to be applied on the locking sleeve in order to firmly press and hold the fastener in position, or the locking sleeve may be slipping against the fastener and result in poor positioning effect.

Referring to FIG. 1, a conventional magnetic sleeve 1 is developed. The magnetic sleeve 1 includes a body 11 formed with a locking socket 111 and a magnetic unit 12 disposed in the body 11. During a fastening operation of a fastener A, the fastener A is inserted into the locking socket 111, and the magnetic force of the magnetic unit 12 can help position the fastener A to thereby facilitate the fastening operation. However, the magnetic sleeve 1 takes an advantage of the magnetic unit 12 to hold the fastener A in position, and that causes the magnetic sleeve 1 can be only adapted to hold the fastener A which is made of a metal material. The positioning effect of the magnetic sleeve 1 will be poor if it is adapted to hold the fastener A which is made of a non-metal material. Further, a great quantity of metal chips produced during the fastening operation may adhere to the magnetic unit 12 easily, and that affects the magnetic force of the magnetic unit 12 and reduces the positioning effect of the magnetic sleeve 1, and that requires to be improved.

Referring to FIG. 2, another conventional locking sleeve 2 is disclosed. The locking sleeve 2 is adapted to hold the fastener which is made of a non-metal material. The locking sleeve 2 includes a body 21 formed with a locking socket 211 and a C-type ring 22 disposed inside the body 21. A periphery of the C-type ring 22 is formed to be smooth and even, namely a cross-sectional view of the C-type ring 22 is formed to have a circular shape as shown in FIG. 2A. The locking socket 211 is enclosed by a plurality of peripheral walls 212 connected one after another. When a fastener B is inserted into the locking socket 211, the fastener B will press the C-type ring 22 first and the elastic force of the C-type ring 22 will then press and hold the fastener B in position. However, the C-type ring 22 has the smooth and even periphery and contacts the fastener B at a single point, and that causes that the C-type ring 22 is difficult to hold the fastener B stably and tightly. If the fastener B is stained by machine oil, it will be more difficult for the locking sleeve 2 to position the fastener B. Meanwhile, the peripheral walls 212 of the locking socket 211 cannot enclose the fastener B tightly due to the different dimensional tolerances. Thus, the fastener B may sway when executing a fastening operation, and that requires to be improved.

SUMMARY OF THE INVENTION

The object of this invention is to provide a non-magnetic locking sleeve capable of holding fastener made of any material in position, positioning the fastener tightly, and increasing the stability of a following fastening operation executed by the fastener.

The non-magnetic locking sleeve comprises a body and an engagement unit disposed inside the body. The body has a second section, a first section connected to an end of the second section, and a locking socket recessed into another end of the second section and adapted to accommodate a fastener. The locking socket is open to an outside and enclosed by a plurality of peripheral walls, with the peripheral walls connected one after another. A positioning groove is annularly recessed into the peripheral walls for accommodating the engagement unit. A periphery of the engagement unit can be formed with a rough surface or at least one engaging surface to thereby increase an area that the engagement unit contacts the fastener when the fastener is inserted into the locking socket, hold the fastener stably, and increase the stability of a following fastening operation executed by the fastener.

Preferably, the engagement unit is a C-type ring.

Preferably, a recessed portion is formed at a place where two adjacent peripheral walls meet.

Preferably, the periphery of the engagement unit is formed with a plurality of engaging surfaces so that the engagement unit has a polygonal shape.

BRIEF DESCRIPTION OF THE DRAWINGS

FIG. 1 is a schematic view showing a conventional magnetic sleeve;

FIG. 2 is a schematic view showing a conventional locking sleeve;

FIG. 2A is an enlarged view of the encircled portion 2A indicated in FIG. 2;

DETAILED DESCRIPTION OF THE PREFERRED EMBODIMENTS

Figure 4:
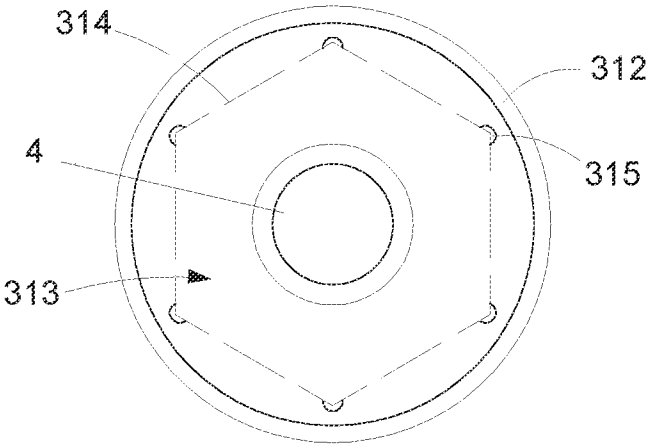
FIG. 4 is a bottom plan view of the first preferred embodiment of this invention.
Figure 3:
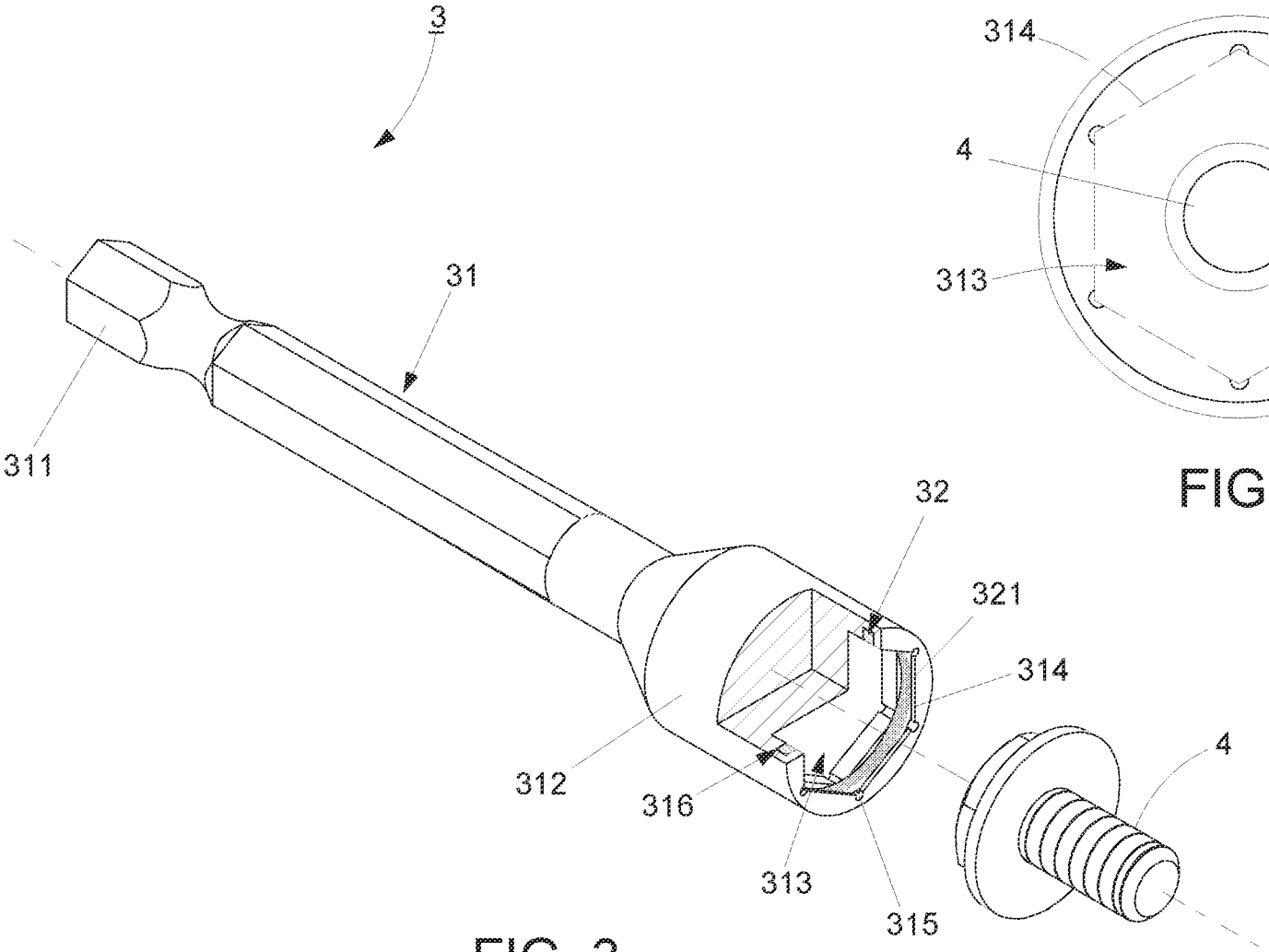
FIG. 3 is a perspective view showing a first preferred embodiment of this invention.

Referring to FIG. 3 and FIG. 4, a first preferred embodiment of a non-magnetic locking sleeve 3 is disclosed. The non-magnetic locking sleeve 3 in this preferred embodiment comprises a body 31 and an engagement unit 32 mounted in the body 31. Here takes an example that the engagement unit 32 is a C-type ring which is formed to have elasticity. The body 31 has a first section 311 configured to be inserted into a drive tool (not shown), a second section 312 connected to the first section 311, and a locking socket 313 recessed into the second section 312. The first section 311 and the locking socket 313 are disposed at two different ends of the second section 312 respectively. The locking socket 313 is open to an outside for accommodating and positioning a fastener 4 and enclosed by a plurality of peripheral walls 314, with the peripheral walls 314 connected one after another at respective joints 300. A positioning groove 316 is annularly recessed into the peripheral walls 314 for receiving the engagement unit 32. Here takes an example that the locking socket 313 is enclosed by six peripheral walls 314 so that the locking socket 313 has a hexagonal shape as shown in FIG. 4. Meanwhile, a recessed portion 315 is formed at each joint 300 where two adjacent peripheral walls 314 meet in this preferred embodiment. Hence, the non-magnetic locking sleeve 3 can be adapted to hold the fastener 4 which is made of a metal or non-metal material in position and stabilize the fastener 4 through the engagement unit 32. Further, the engagement unit 32 has a rough surface 321 formed on a periphery of the engagement unit 32. The rough surface 321 is configured to be in contact with the fastener 4 when the fastener 4 is inserted into the locking socket 313. The rough surface 321 is a surface which is uneven or is not smooth and can be formed by grit blasting or die forming.

Figure 5A:
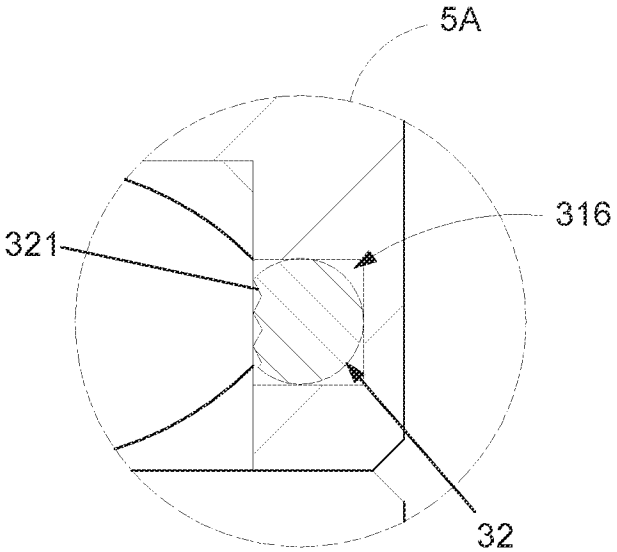
FIG. 5A is an enlarged view of the encircled portion 5A indicated in FIG. 5.
Figure 5:
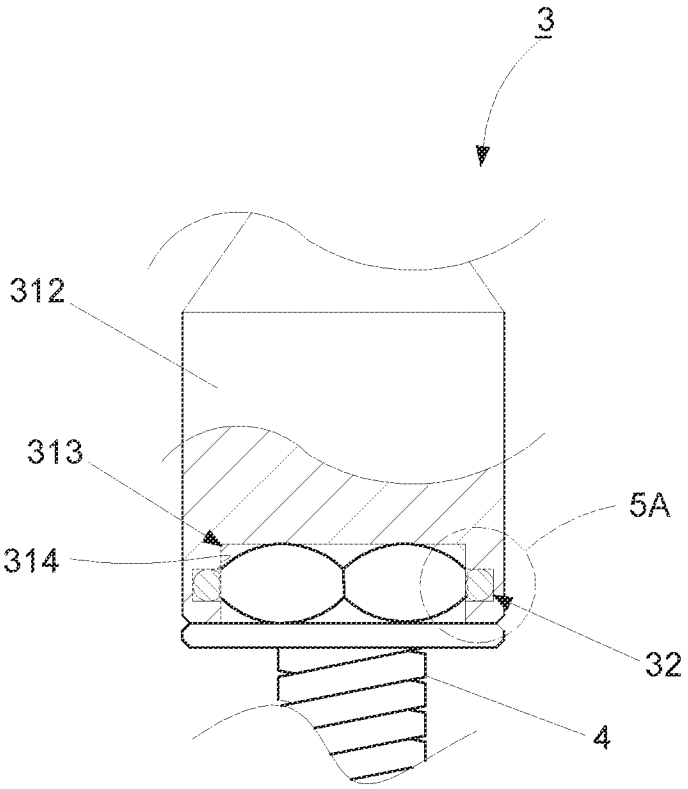
FIG. 5 is a schematic view showing that a fastening operation of the first preferred embodiment of this invention.

Referring to FIG. 3, FIG. 5 and FIG. 5A, when using the non-magnetic locking sleeve 3, the first section 311 is inserted into a drive tool (not shown) and a head of a fastener 4 is positioned at a periphery of the locking socket 313. Here takes an example that the head of the fastener 4 has a hexagonal shape. When the head of the fastener 4 is inserted into the locking socket 313, the recessed portion 315 formed at the joint 300 where two adjacent peripheral walls 314 meet allows the locking socket 313 to extend slightly, and therefore, the peripheral walls 314 can tightly fit a periphery of the head of the fastener 4 and hold the fastener 4 more tightly. Thus, the recessed portion 315 allows the non-magnetic locking sleeve 3 to be adapted to accommodate the fastener 4 with different dimensional tolerances and ensures that the peripheral walls 314 stably enclose the head of the fastener 4. Meanwhile, the rough surface 321 of the engagement unit 32 can help increase a contact area between the engagement unit 32 and the fastener 4 when the fastener 4 is inserted into the locking socket 313 to thereby hold the fastener 4 in position and increase the stability of a following fastening operation executed by the fastener 4. Deficiencies of the conventional locking sleeve 2 such as unstable positioning caused by a smooth periphery of the engagement unit 22 and by single point contact between the fastener B and the engagement unit 22 are also improved.

Figure 6A:
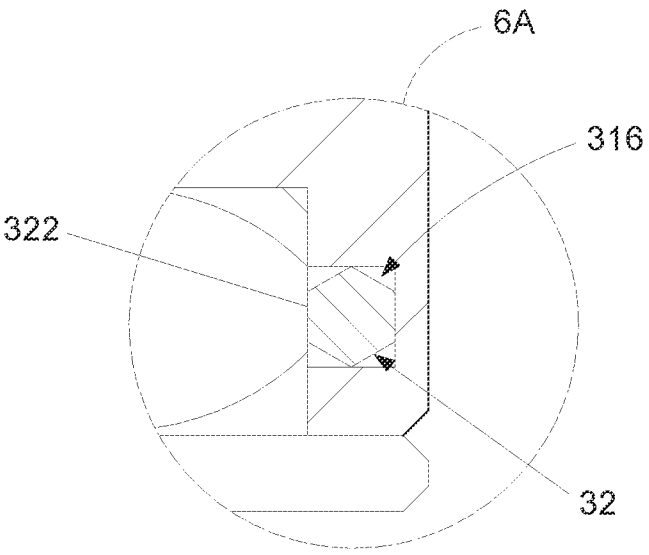
FIG. 6A is an enlarged view of the encircled portion 6A indicated in FIG. 6.
Figure 6:
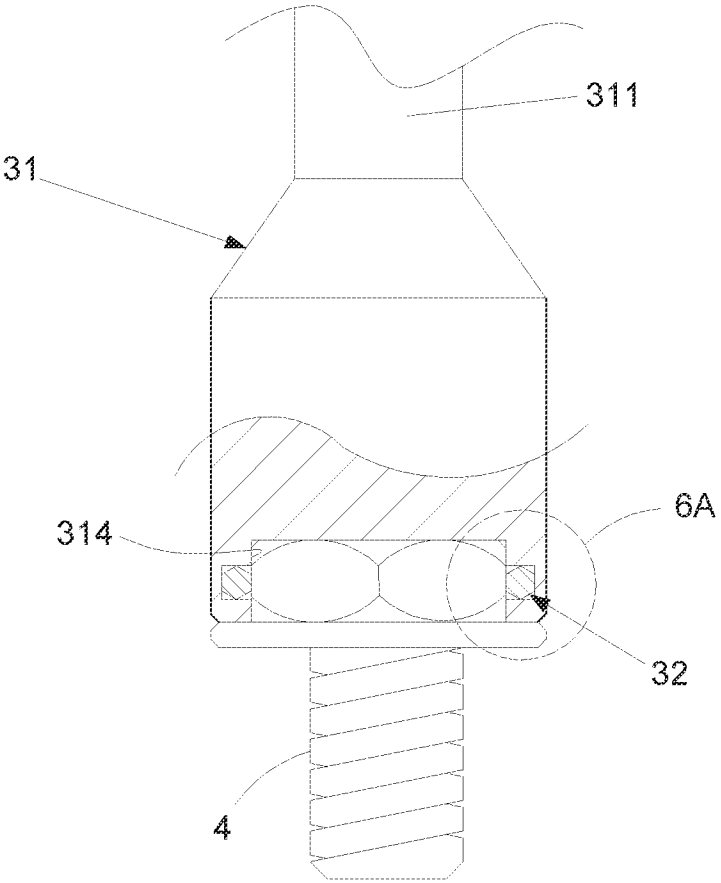
FIG. 6 is a schematic view showing a second preferred embodiment of this invention characterized by the engaging surfaces.

Referring to FIG. 6 and FIG. 6A show a second preferred embodiment of the non-magnetic locking sleeve 3 of this invention. The correlated elements and the concatenation of elements, the operation and objectives of the second preferred embodiment are the same as those of the first preferred embodiment. This embodiment is characterized in that a periphery of the engagement unit 32 is formed with a plurality of engaging surfaces 322 so that the engagement unit 32 has a polygonal shape. The engaging surfaces 322 are configured to be in contact with the fastener 4 when the fastener 4 is inserted into the locking socket 313. Here takes an example that the engaging surfaces 322 enclose a hexagonal shape for accommodating a hexagonal head of the fastener 4. During producing the engagement unit 32, a blank material (not shown) is prepared. The blank material is shaped to have six engaging surfaces 322 which are formed on a periphery of the blank material so that the engagement unit 32 can have a hexagonal shape as shown in the cross-sectional view of FIG. 6A. The shaped blank material is then bent to have a C shape to complete the engagement unit 32 and positioned into the positioning groove 316 after being bent. When the fastener 4 is inserted into the locking socket 313 and engaged with the engagement unit 32, the engaging surfaces 322 can increase an area that the engagement unit 32 contacts the fastener 4 to thereby enhance the engaging force of the engagement unit 32 applied to the fastener 4, hold the fastener 4 in position stably, and increase the stability of a following fastening operation executed by the fastener 4.

To sum up, the non-magnetic locking sleeve of this invention takes advantages that a periphery of the engagement unit can be formed with a rough surface or at least one engaging surface to increase a contact area between the engagement unit and the fastener when the fastener is inserted into the locking socket to thereby hold the fastener in position stably and increase the stability of a following fastening operation executed by the fastener. Preferably, an intersection of two adjacent peripheral walls forms the recessed portion whereby the fastener is held by the peripheral walls more tightly while inserting into the locking socket.

While the embodiments of this invention are shown and described, it is understood that further variations and modifications may be made without departing from the scope of this invention.

What is claimed is:

1. A non-magnetic locking sleeve comprising:

a body, said body including a second section, a first section connected to one end of said second section, and a locking socket recessed into another end of said second section and adapted to accommodate a fastener, said locking socket being configured with an outside opening enclosed within and defined by a plurality of peripheral walls, wherein said plurality of peripheral walls are connected in a continuous sequence to one another at respective joints, wherein each joint is formed between adjacent peripheral walls of said plurality of peripheral walls, a positioning groove recessed into said plurality of peripheral walls, and a plurality of recessed portions, each recessed portion of said plurality thereof being formed at a respective joint between respective adjacent peripheral walls; and an engagement unit disposed inside said positioning groove of said body, said engagement unit being fabricated with a rough surface formed on a periphery of said engagement unit, said rough surface being in contact with the fastener inserted into said locking socket, thereby holding the fastener in position.

2. The non-magnetic locking sleeve according to claim 1, wherein said engagement unit is a C-type ring.

3. A non-magnetic locking sleeve comprising:

a body, said body including a second section, a first section connected to one end of said second section, and a locking socket recessed into another end of said second section and adapted to accommodate a fastener, said locking socket being configured with an outside opening enclosed within and defined by a plurality of peripheral walls, wherein said plurality of peripheral walls are connected in a continuous sequence to one another at respective joints, wherein each joint is formed between adjacent peripheral walls of said plurality of peripheral walls, a positioning groove recessed in a continuous configuration into said plurality of peripheral walls and extending in a crossing relationship with a longitudinal axis of said locking socket, and a plurality of recessed portions, each recessed portion of said plurality thereof being formed at a respective joint between respective adjacent peripheral walls; and an engagement unit disposed inside said positioning groove of said body, said engagement unit having a periphery configured with six engaging surfaces arranged in a hexagonal configuration, one surface of said six engaging surfaces of the engagement unit extending continuously to define an enclosure for receiving the fastener therein, wherein said engagement unit is disposed in said positioning groove with said one surface of said six engaging surfaces embracing the fastener in a direct contact with the peripheral surface of the fastener inserted into said enclosure defined by said one surface of the engagement unit in the locking socket to thereby hold the fastener in position.

4. The non-magnetic locking sleeve according to claim 3, wherein said engagement unit is a C-type ring.

* * * * *